United States Patent [19]

Sorci

[11] Patent Number: 4,955,502

[45] Date of Patent: Sep. 11, 1990

[54] FIVE CELL PARTITION

[75] Inventor: Anthony L. Sorci, Springfield, Mo.

[73] Assignee: Container Corporation of America, Clayton, Mo.

[21] Appl. No.: 411,447

[22] Filed: Sep. 25, 1989

[51] Int. Cl.[5] ..... B65D 5/48

[52] U.S. Cl. ..... 220/22; 229/120.24; 229/120.26

[58] Field of Search ..... 220/22; 229/120.24, 229/120.26

[56] References Cited

U.S. PATENT DOCUMENTS

| | | | |
|---|---|---|---|
| 1,770,701 | 7/1930 | Kelly | 229/120.24 |
| 2,593,092 | 4/1952 | Bergstein | 229/120.26 |
| 3,199,759 | 4/1965 | Hickin | 229/120.26 |
| 3,201,022 | 8/1965 | Glassco | 229/120.24 |
| 3,260,440 | 7/1966 | Foley | 229/120.26 |
| 3,770,184 | 11/1973 | Rockefeller | 229/120.26 |
| 3,931,924 | 1/1976 | Gardner | 229/120.26 |
| 4,130,235 | 12/1978 | Killy | 229/120.26 |
| 4,171,762 | 10/1979 | Matthews | 229/120.26 |
| 4,251,020 | 2/1981 | Schwaner | 229/120.24 |
| 4,272,008 | 6/1981 | Wozniacki | 229/120.26 |
| 4,299,351 | 11/1981 | Gardner | 229/120.26 |
| 4,320,867 | 3/1982 | Gardner | 229/120.26 |
| 4,335,842 | 6/1982 | Bradford | 229/120.24 |
| 4,375,263 | 3/1983 | Dworkin | 229/120.24 |
| 4,376,507 | 3/1983 | Nauheimer | 229/120.24 |

FOREIGN PATENT DOCUMENTS

| | | | |
|---|---|---|---|
| 1539148 | of 0000 | France | 229/120.24 |
| 2491874 | 4/1982 | France | 229/120.26 |

*Primary Examiner*—Stephen P. Garbe
*Assistant Examiner*—Stephen Castellano
*Attorney, Agent, or Firm*—Richard W. Carpenter

[57] ABSTRACT

A collapsible partition structure formed from a unitary blank of foldable sheet material, such as paperboard, that has two sections arranged in parallel side-by-side relation, whereby the blank can be erected to provide five separate adjacent cells aligned in a row within an outer container or wrapper.

4 Claims, 1 Drawing Sheet

FIVE CELL PARTITION

BACKGROUND OF THE INVENTION

1. Field of the Invention:

This invention relates generally to partitions, and more particularly to a one-piece partition, formed of foldable sheet material such as paperboard or the like, which can be readily erected by folding the panels of the blank at certain angles relative to each other to provide five separate cells when the erected partition is placed within an outer container or wrapper.

2. Description of the Background Art:

A background search conducted in the United States Patent and Trademark Office disclosed the following United States Letters Patent:

| | | |
|---|---|---|
| 101,092 | 137,791 | 979,373 |
| 2,267,378 | 2,593,092 | 3,199,759 |
| 3,260,440 | 3,931,924 | 4,130,235 |
| 4,171,762 | 4,272,008 | 4,299,351 |
| 4,335,842 | 4,320,867 | 4,376,507 |

None of the patents found in the search discloses a five cell partition formed from a unitary blank and having a pair of first and second sections foldably interconnected at certain edges and presenting pairs of first and second inner and outer side panels connected to each other by pairs of intermediate and end panels in the manner of applicant's invention.

SUMMARY OF THE INVENTION

It is an object of the present invention to provide a five cell partition structure formed from a unitary blank of foldable sheet material, such as paperboard or plastic material, that can be easily erected.

Another object of the invention is the provision of a partition structure formed from a unitary blank of foldable sheet material and having a pair of sections of substantially the same width and length that are arranged in side-by-side relation.

These and other objects of the invention will be apparant from an examination of the follow description and drawings.

It will be understood that, for purposes of clarity, certain elements may have been intentionally omitted from certain views where they are believed to be illustrated to better advantage in other views.

DESCRIPTION OF THE PREFERRED EMBODIMENT

Figure 1:
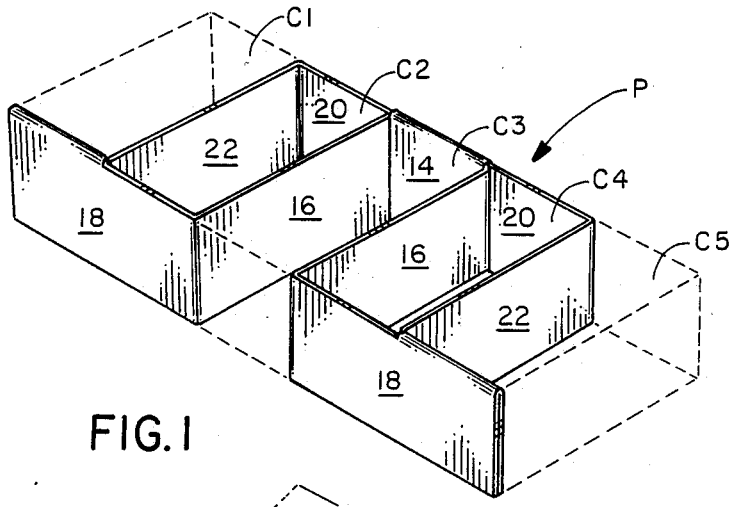
FIG. 1 is an isometric view of a partition structure embodying features of the invention, as shown in the erected condition.
Figure 2:
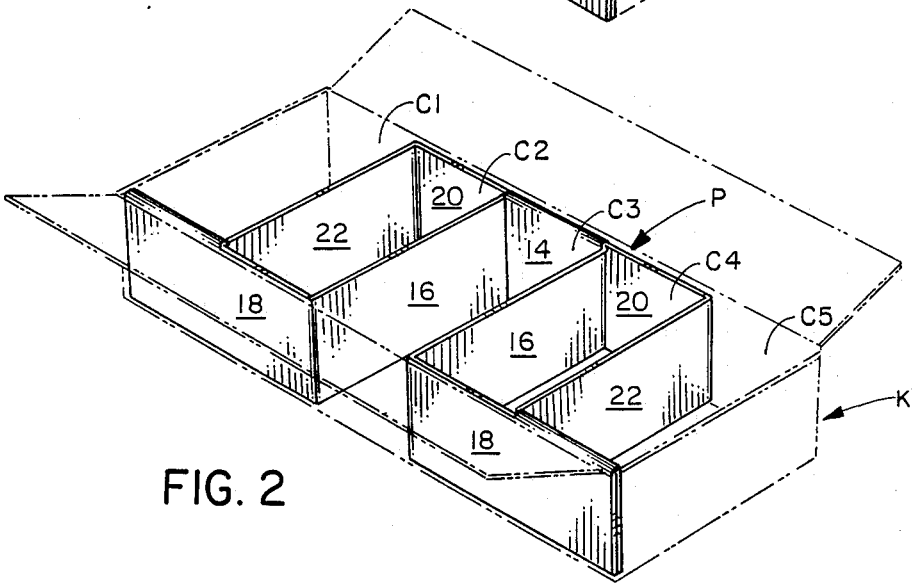
FIG. 2 is a view similar to that of FIG. 1, but showing the erected partition structure positioned within an outer container.
Figure 3:
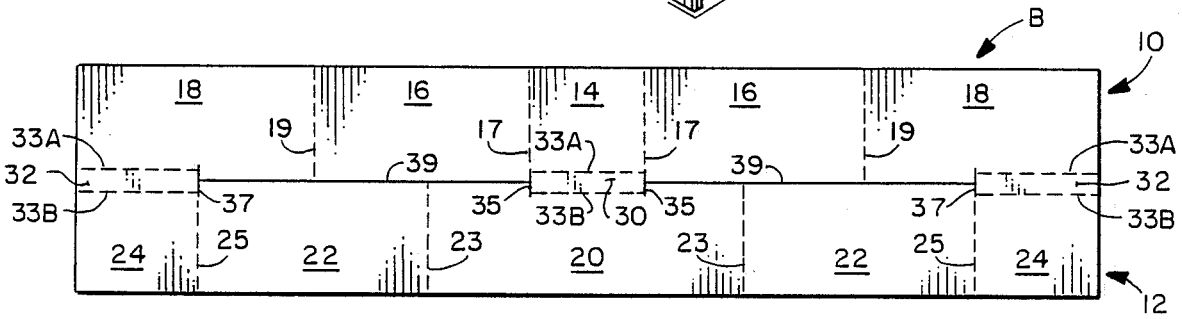
FIG. 3 is a plan view of a blank of foldable sheet material from which the partition structure illustrated in the other views may be formed.

Referring now to the drawings for a better understanding of the invention, it will be seen that the erected partition, indicated generally at P in FIGS. 1 and 2, may be formed from the unitary blank B of foldable sheet material, such as paperboard or plastic material, illustrated in FIG. 3.

Blank B includes a pair of first and second sections 10 and 12, respectively, which are of substantially the same length and width, and which are arranged in parallel side-by-side relation and interconnected in a manner hereinafter described.

First section 10 includes a centrally disposed first side inner panel 14, a pair of intermediate panels 16 having inboard ends foldably joined along fold lines 17 to opposite ends of first side inner panel 14, and a pair of second side outer panels 18 having inboard ends foldably joined along fold lines 19 to corresponding outboard ends of respective intermediate panels 16.

Second section 12 includes a centrally disposed first side outer panel 20, a pair of end panels 22 having inboard ends foldably joined along fold lines 23 to opposite ends of first side outer panel 20, and a pair of second side inner panels 24 having inboard ends foldably joined along fold lines 25 to outboard ends of respective end panels 24.

First side panels 14 and 20 have corresponding upper edges connected to each other by a relatively small and narrow connecting panel 30, and second side panels 18 and 24 are connected to each other by other similar connecting panels 32.

Each connecting panel is foldably joined to the side panels of the first and second sections along a pair of parallel fold lines **33*a* and 33*b***, respectively.

At each end of connecting panel 30 there is a small cut line 35 extending transversely of the connecting panel to separate it from its related side panels. Likewise, at the inboard end of each connecting panel 32 there is a small cut line 37 extending transversely of the connecting panel to separate it from its related side panels.

The first and second sections 10 and 12, respectively, of the blank B are separated from each other by cut lines 39 which extend longitudinally of the blank from connecting panel 30 to each of the connecting panels 32.

Figure 4:
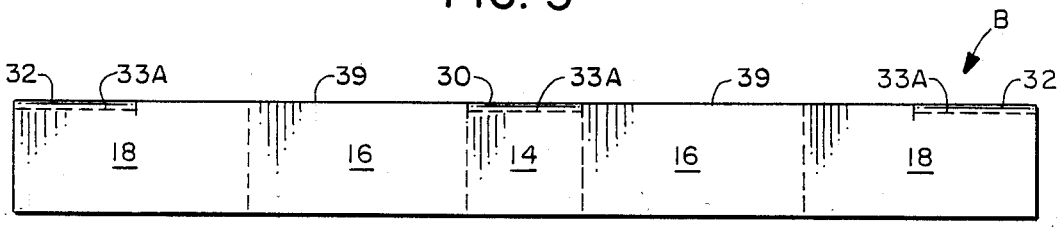
FIG. 4 is a side elevational view illustrating one step in the folding sequence required to form the erected partition.

Referring now to FIGS. 1, 2, and 4, it will be seen that the partition structure can be easily erected from the flat condition illustrated in FIG. 3 to the partially erected condition illustrated in FIG. 4 to the fully erected condition illustrated in FIGS. 1 and 2.

When the partition is fully erected it can be placed within an outer receptacle, such as the shipping container indicated generally at K in FIG. 2, with the first side panels disposed against each other and against one side wall of the container, with the second side panels disposed against each other and against an opposed side wall of the container, and with the intermediate and end panels extending between the opposed first and second side panels to form, in cooperation with the outer container walls, five separate cells indicated at C1, C2, C3, C4, and C5 which are aligned with each other.

What is claimed is:

1. A collapsible partition structure formed from a unitary blank of foldable sheet material, such as paperboard, and adapted, when placed within an outer container having opposed first and second side walls and opposed first and second end walls, to provide five separate adjacent cells aligned in a row, said partition structure comprising:

(a) a first side outer panel adapted to lie against a container first side wall with opposed ends of said first side outer panel being spaced inboardly from respective container end walls;

(b) a first side inner panel having a length less than that of said first side outer panel and disposed against an inner surface of said first side outer panel intermediate said opposed ends of said first side outer panel;

(c) a pair of second side outer panels disposed to lie against a container second side wall;

(d) said second side outer panels being spaced from each other and having corresponding outboard ends disposed adjacent respective container end walls;

(e) a pair of second side inner panels, each having a length less than that of either of said second side outer panels, disposed against inner surfaces of respective second side outer panels;

(f) a pair of intermediate panels having corresponding first ends foldably joined to opposed ends of said first side inner panel and having corresponding second ends foldably joined to corresponding inboard ends of respective second side outer panels;

(g) a pair of end panels having corresponding first ends foldably joined to opposed ends of said first side outer panel and having corresponding second ends foldably joined to corresponding inboard ends of respective second side inner panels;

(h) means interconnecting adjacent upper edges of said first side panels to each other and means interconnecting upper edges of said second side panels to each other.

2. A five-cell container including an outer box, having a bottom wall with opposed first and second side walls and opposed first and second end walls joined to each other and to said bottom wall and upstanding therefrom, and a separate collapsible partition structure adapted, when placed within said outer box, to form with the walls thereof five separate cells aligned in a row, said structure being formed from a unitary blank of foldable sheet material, such as paperboard, and comprising:

(a) a first side outer panel adapted to lie against a container first side wall with opposed ends of said first side outer panel being spaced inboardly from respective container end walls;

(b) a first side inner panel having a length less than that of said first side outer panel and disposed against an inner surface of said first side outer panel intermediate said opposed ends of said first side outer panel;

(c) a pair of second side outer panels disposed to lie against a container second side wall;

(d) said second side outer panels being spaced from each other and having corresponding outboard ends disposed adjacent respective container end walls;

(e) a pair of second side inner panels, each having a length less than that of either of said second side outer panels, disposed against inner surfaces of respective second side outer panels;

(f) a pair of intermediate panels having corresponding first ends foldably joined to opposed ends of said first side inner panel and having corresponding second ends foldably joined to corresponding inboard ends of respective second side outer panels;

(g) a pair of end panels having corresponding first ends foldably joined to opposed ends of said first side outer panel and having corresponding second ends foldably joined to corresponding inboard ends of respective second side inner panels;

(h) means interconnecting adjacent upper edges of said first side panels to each other and means interconnecting upper edges of said second side panels to each other.

3. A partition structure according to claim 1, wherein said interconnecting means includes connecting panels foldably interconnecting said first side panels to each other and said second side panels to each other.

4. A partition structure according to claim 2, including connecting panels foldably interconnecting said first side panels to each other and said second side panels to each other.

* * * * *